US005662241A

United States Patent [19]

Sorensen

[11] Patent Number: 5,662,241

[45] Date of Patent: Sep. 2, 1997

[54] CONTAINER AND STAND FOR LIQUIDS

[76] Inventor: Charles K. Sorensen, 9 Spur Cir., Scottsdale, Ariz. 85251

[21] Appl. No.: 497,922

[22] Filed: Jul. 3, 1995

[51] Int. Cl.[6] ..... B65D 41/00

[52] U.S. Cl. ..... 220/630; D21/209

[58] Field of Search ..... 220/630; 215/13 R; D21/209

[56] References Cited

U.S. PATENT DOCUMENTS

| | | | |
|---|---|---|---|
| D. 195,088 | 4/1963 | Box | D21/209 |
| D. 228,328 | 9/1973 | Schley | D7/5 |
| D. 258,125 | 2/1981 | Bailey | D21/209 X |
| D. 275,303 | 8/1984 | Box, Sr. | D21/209 |
| D. 291,714 | 9/1987 | Spiegel | D21/209 |
| D. 354,642 | 1/1995 | Stoddard | D6/450 |
| 2,516,703 | 7/1950 | Kent | 65/31 |
| 2,948,452 | 8/1960 | Grogan et al. | 229/1.5 |
| 4,164,284 | 8/1979 | Witt et al. | 206/217 |
| 4,399,926 | 8/1983 | Eidels-Dubovoy | 220/288 |

*Primary Examiner*—Steven M. Pollard
*Attorney, Agent, or Firm*—Warren F. B. Lindsley

[57] ABSTRACT

A novel combination is disclosed comprising a container for liquids and a stand. The container comprises a hollow container body with an upper end and a lower end. The upper end has a neck portion having an opening therethrough whereby a removable cap attaches to the neck portion for sealing and unsealing the opening. A top is joined to the upper end of the container body whereby the joined top and body simulate a football. The lower end of the body is removably mounted to the stand, the stand simulating a football tee. The stand comprises a U-shaped portion having a base and arms extending laterally therefrom, with the base further having a notch centered therein. The notch receives the lower end of the body. The stand further includes legs mounted on each arm opposite said base, the legs extending upwardly therefrom to engage and support the body.

5 Claims, 3 Drawing Sheets

CONTAINER AND STAND FOR LIQUIDS

BACKGROUND OF THE INVENTION

This invention relates to a novel container for liquids having a stand associated therewith, and, more particularly, to a football shaped container having either a screw cap or flip top opening at one end and being mountable at its other end on a tee shaped stand having a notch for collecting condensation.

DESCRIPTION OF THE PRIOR ART

U.S. Pat. No. D 228,328 shows a combined drinking mug and stand comprising a football on a tee.

U.S. Pat. No. D 354,642 shows a display cooler which appears to be a football mounted on a tee.

U.S. Pat. No. 4,164,284 discloses a liquid container novelty in the form of a football having a screw top.

U.S. Pat. No. 2,948,452 shows an ice cream holder made of plastic and having a drip catching apron.

U.S. Pat. No. 2,516,703 shows a pitcher having a drip receptacle.

The known prior art is described above. None of the known prior art disclose the device set forth and claimed herein.

SUMMARY OF THE INVENTION

In accordance with the invention claimed, one object of this invention is to provide a football shaped novel container.

Another object of this invention to provide a football shaped novel container having either a screw cap or flip top opening.

A further object of this invention is to provide a football shaped novel container mountable on a tee shaped stand having a notch in the stand for collecting condensation.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

In accordance with the invention claimed, FIGS. 1–15 disclose various embodiments of a novel container 10 for liquids having a stand 12 associated therewith. In the illustrated form, novel container 10 is constructed to simulate a football and stand 12 is constructed to simulate a football tee. It should be understood that the principles of this invention are applicable to other sports such as soccer, basketball and the like.

Figure 11:
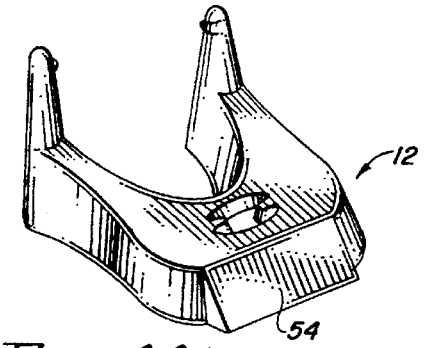
FIG. 11 is a perspective view showing further embodiment of the stand shown in FIGS. 1, 3, 4 and 6.
Figure 14:
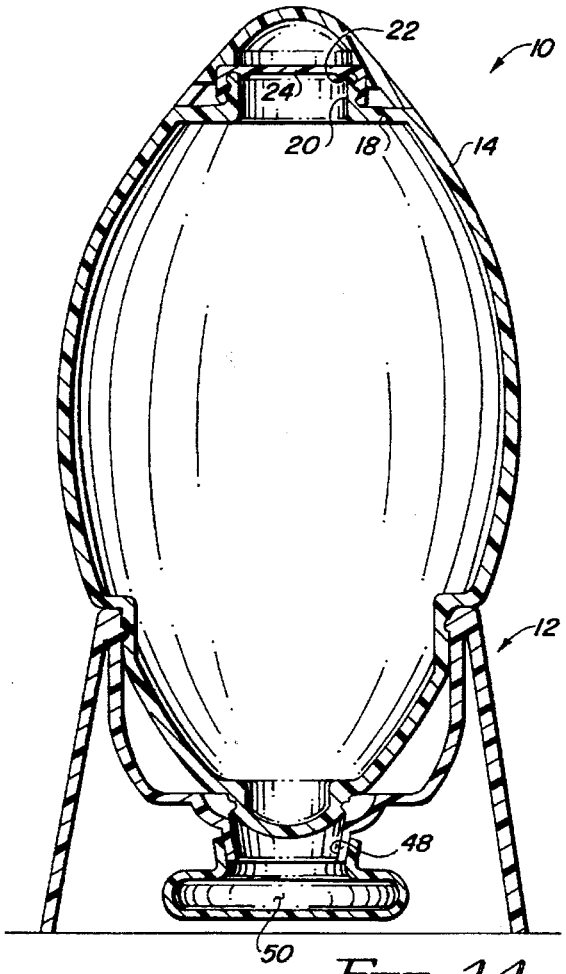
FIG. 14 is a cross sectional view of the embodiment shown in FIG. 11.
Figure 15:
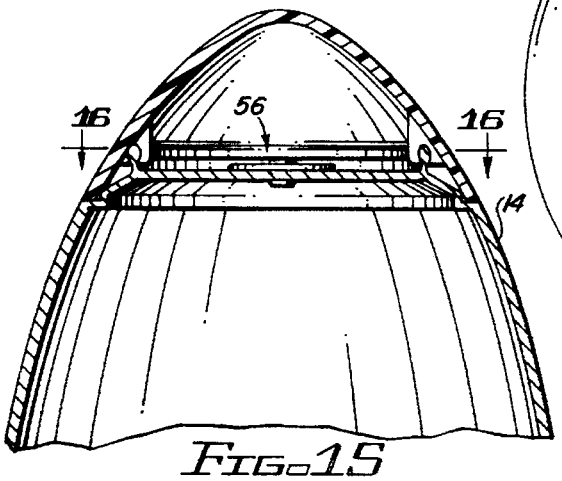
FIG. 15 is a top view of a flip top opener for the football embodiments shown in FIGS. 1, 6 and 11.

Container 10 comprises a hollow container body 14 and a top 16 which joins with container body 14. When so joined, body 14 and top 16 simulate the football shape. In the preferred embodiments, body 14 is sized to hold approximately 12 fluid ounces of liquid. To maintain the appearance of the football even when top 16 is removed, the size of top 16 can be minimized as best seen in FIGS. 11 and 14.

Figure 1:
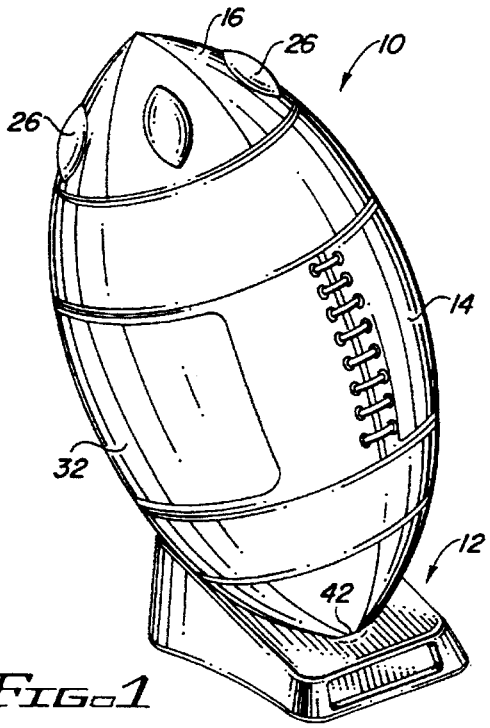
FIG. 1 is a perspective view of one embodiment of the present invention having a screw top opening for the container.
Figure 6:
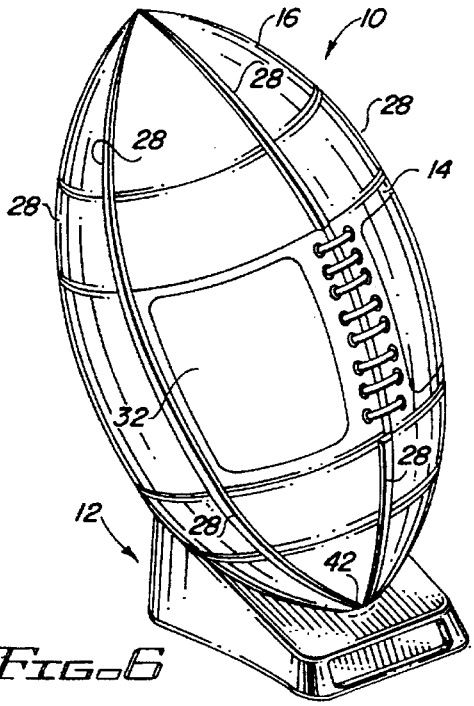
FIG. 6 is a perspective view of an alternate embodiment of the present invention.
Figure 2:
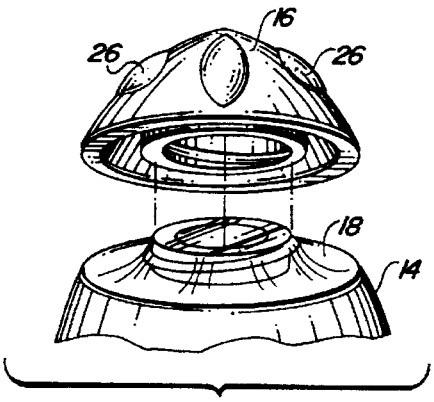
FIG. 2 is a partial exploded view showing a screw top removed from the embodiment shown in FIG. 1.
Figure 5:
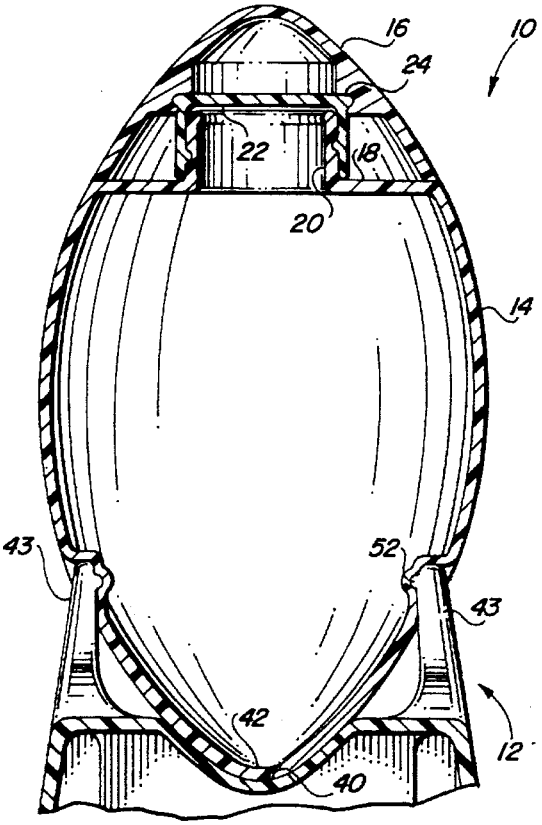
FIG. 5 is a cross sectional view of the embodiment shown in FIG. 1.

Upper end 18 of body 14 which corresponds to top 16 includes a neck portion 20 having an opening 22 therethrough. A removable cap 24 is provided for sealing and unsealing opening 22. In the embodiments best seen in FIGS. 2, 5 and 14, cap 24 is integral with top 16 whereby both screw onto neck portion 20 to seal opening 22. In the embodiments of FIGS. 2 and 5, a plurality of protuberances 26 extending from top 16 provide a grip for a user to remove top 16 and cap 24 to gain access to the contents of body 14. In the embodiment of FIG. 11, the plurality of ribs 28 provide the grip for the user.

Figure 7:
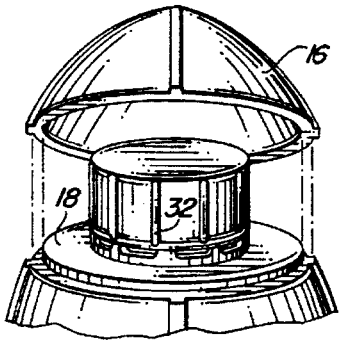
FIG. 7 is a partial exploded view of FIG. 6 showing a pop off top of the football with screw top for the container.
Figure 8:
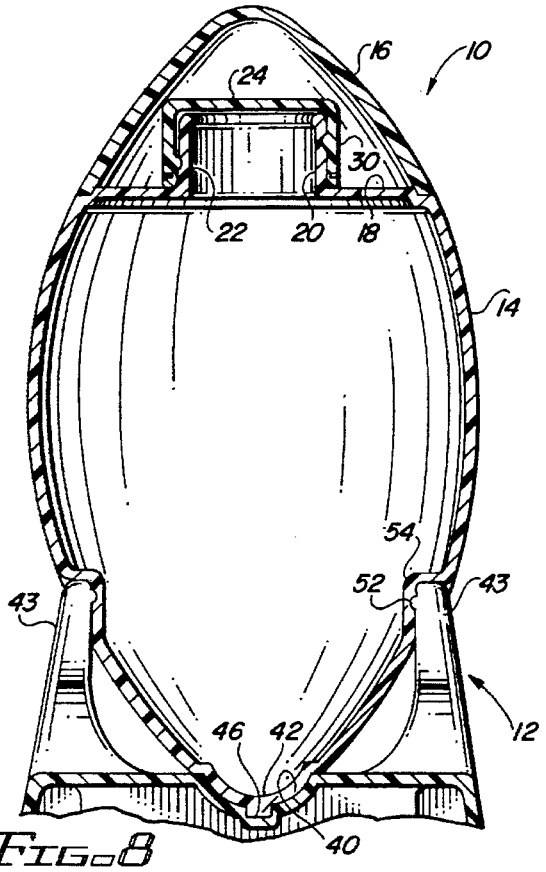
FIG. 8 is a cross sectional view of the embodiment shown in FIG. 6.

In the embodiment best seen in FIGS. 7 and 8, top 16 is press fit to body 14. Cap 24 is a separate piece which screws onto neck portion 20 thereby sealing opening 22. As in FIG. 6, ribs 28 provide a grip for the user to remove top 16 and a second set of ribs 30 are provided on cap 24 to facilitate removal thereof.

Figure 16:
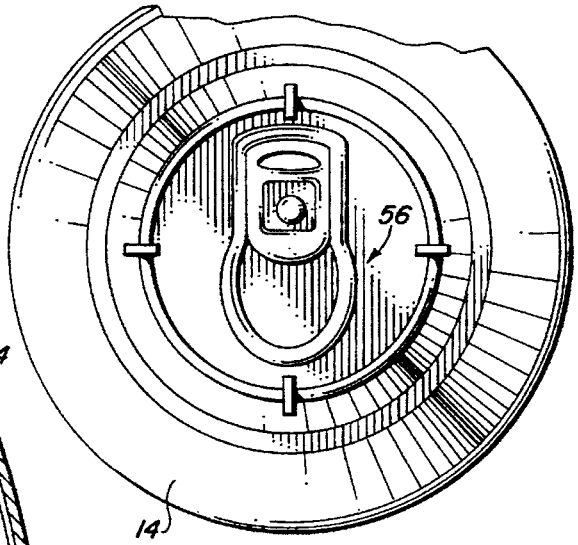
FIG. 16 is a top view of the flip top opener shown in FIG. 15.

While the preferred embodiments utilize caps 24 removably screwed onto neck portion 20, other methods of sealing and unsealing opening 22 are well known in the art. For example, flip tops, bottle caps and press fittings could be used if desired with flip top 56 shown in FIGS. 15 and 16 being an example of another container closing means.

Figure 12:
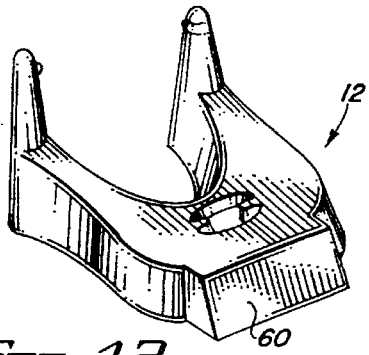
FIG. 12 is a further embodiment of the stand shown in FIGS. 1, 3, 4 and 6.
Figure 13:
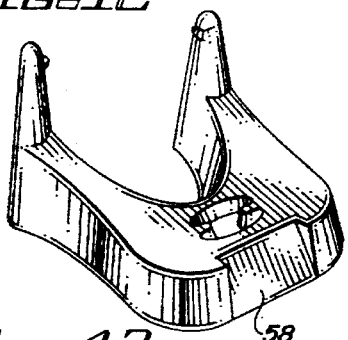
FIG. 13 is another embodiment of the stand shown in FIGS. 1, 3, 4, 6 and 12.

For advertising and labeling purposes, indicia are printed on a label 32 provided on the exterior of body 14 and on surfaces 54, 60 and 58 shown in FIGS. 11, 12 and 13.

Figure 3:
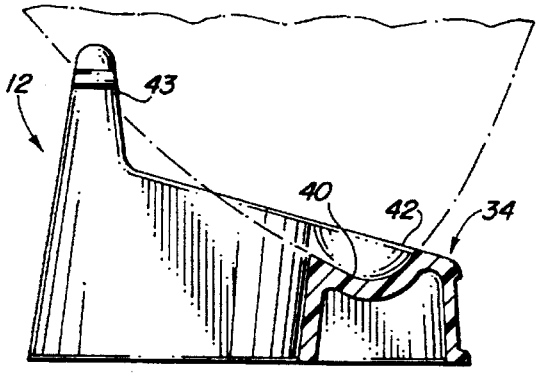
FIG. 3 is a partial cross sectional side view of the stand shown in FIG. 1.
Figure 4:
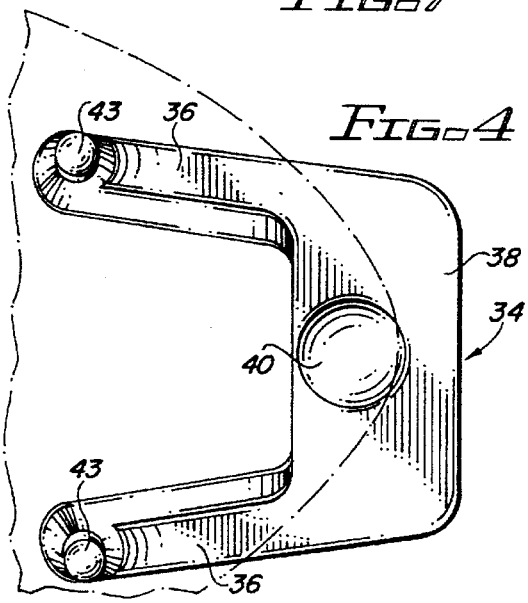
FIG. 4 is a top view of the stand shown in FIG. 3.

Referring now to FIGS. 3 and 4, stand 12 comprises a U-shaped portion 34 having arms 36 extending laterally from a base 38. A notch 40 centered in base 38 receives a lower end 42 of body 14, lower end 42 opposing upper end 18. Mounted opposite base 38 on each arm 36 are legs 43 extending upwardly therefrom.

Figure 9:
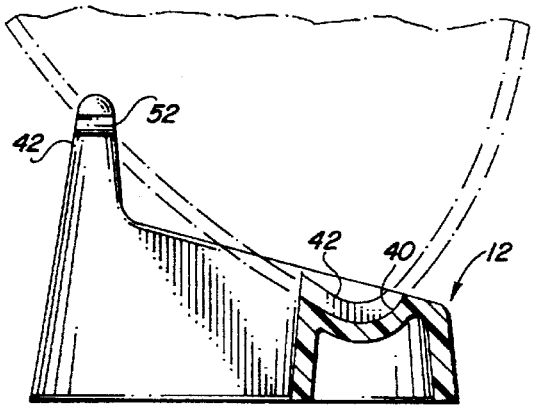
FIG. 9 is a partial cross sectional side view of the stand shown in FIG. 6.
Figure 10:
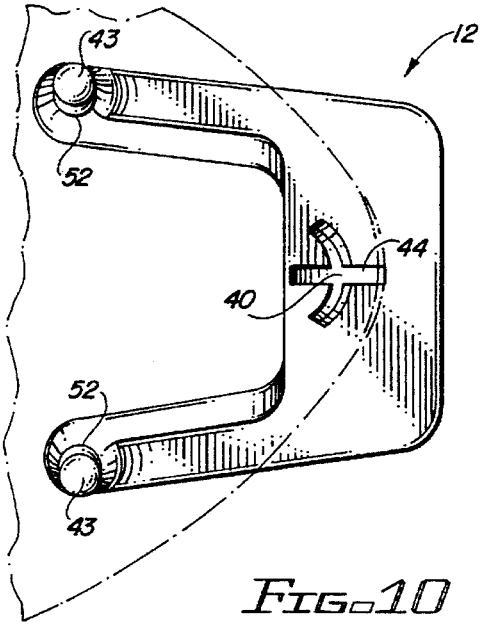
FIG. 10 is a top view of the stand shown in FIG. 9.

As best seen in FIGS. 3 and 4, notch 40 can be a depression corresponding in shape to lower end 42 of body 14. However, as best seen in FIGS. 9 and 10, notch 40 can also include channels 44 which correspond to raised portions 46 located on lower end 42 of the hollow container to more firmly mount container 10 to stand 12.

In still another embodiment best seen in FIG. 14, notch 40 can include a drip opening 48 providing communication between notch 40 and a moisture chamber 50 mounted underneath notch 40. Moisture chamber 50 is used to collect condensation dripping from body 14.

FIGS. 5, 8 and 14 illustrate that the inner edge of legs 43 include tongues 52 which mate with grooves on body 14 to provide a removable press fit attachment thereto. In addition, the top of legs 43 mate with indentations in body 14 to provide support thereto.

Although only certain embodiments of the invention have been illustrated and described, it will be apparent to those skilled in the art that various changes and modifications may be made therein without departing from the spirit of the invention or from the scope of the appended claims.

That which is claimed is:

1. A novel combination of a container for liquids and a stand therefor, the container comprising:

a hollow container body, the hollow container body having an upper end and a lower end, the upper end having an opening therethrough, a top which joins with the upper end of the container body to simulate a shape, means for sealing and unsealing the opening, the lower end of the body simulating the top and being removably mounted to the stand, wherein said shape is a football and said stand is a football tee, wherein the stand comprises a U-shaped portion having a base and arms extending laterally therefrom, said base further having a notch centered therein, said notch receiving the lower end of said body, legs being mounted on each arm opposite said base, said legs extending upwardly therefrom to engage said body, said notch comprising a depression which receives said lower end, said notch further including channels and the lower end further having raised portions, said raised portions mating with said channels to more firmly mount the container to the stand, and said stand further comprising a moisture chamber and said notch further including a drip opening providing communication between the notch and the moisture chamber whereby condensation dripping from the container collects in the moisture chamber.

2. A combination of a novel container for liquids and a stand, the container comprising:

a hollow container body, the hollow container body having an upper end and a lower end, the upper end having a neck portion having an opening therethrough, a top which joins with the upper end of the container body to simulate a football, a removable cap attached to the neck portion for sealing and unsealing the opening, the lower end of the body being removably mounted to the stand, the stand simulating a football tee, said stand comprising a U-shaped portion having a base and arms extending laterally therefrom, said base further having a notch centered therein, said notch receiving the lower end of said body, legs mounted on each arm opposite said base, said legs extending upwardly therefrom to engage said body, and said novel combination comprising a moisture chamber, the notch further including a drip opening providing communication between the notch and the moisture chamber whereby condensation dripping from the container collects in the moisture chamber.

3. A novel combination of a container for liquids and a stand therefor, the container comprising:

a hollow container body, the hollow container body having an upper end and a lower end, the upper end having an opening therethrough, a top which joins with the upper end of the container body to simulate a shape, means for sealing and unsealing the opening, and the lower end of the body simulating the top and being removably mounted to the stand, wherein said shape is a football and said stand is a football tee, and said stand comprising a U-shaped portion having a base and arms extending laterally therefrom, the base further having a notch centered therein, said notch receiving the lower end of said body, and legs mounted on each arm opposite said base, said legs extending upwardly therefrom to engage said body, said legs including tongues which mate with grooves on the body to provide a removable press fit attachment thereto.

4. The novel combination of claim 3 wherein the upper end of said body includes a neck portion having the opening therethrough, the means for sealing and unsealing being a removable cap attached to said neck portion.

5. The novel combination of claim 3 wherein the cap is integral with the top.

* * * * *